United States Patent [19]

Sako et al.

[11] Patent Number: 4,924,270

[45] Date of Patent: May 8, 1990

[54] TONER SUPPLY DEVICE FOR USE IN IMAGE FORMING APPARATUS

[75] Inventors: Mineyuki Sako; Tateki Oka; Yasuyuki Hiromoto; Tomoaki Yokoyama; Kunio Toda, all of Osaka, Japan

[73] Assignee: Minolta Camera Kabushiki Kaisha, Osaka, Japan

[21] Appl. No.: 263,415

[22] Filed: Oct. 27, 1988

[30] Foreign Application Priority Data

| | | | |
|---|---|---|---|
| Oct. 29, 1987 | [JP] | Japan | 62-274161 |
| Oct. 29, 1987 | [JP] | Japan | 62-274162 |
| Oct. 29, 1987 | [JP] | Japan | 62-274163 |
| Oct. 29, 1987 | [JP] | Japan | 62-274164 |

[51] Int. Cl.[5] ..... G03G 21/00; G03G 15/06; B05C 11/00

[52] U.S. Cl. ..... 355/246; 355/203; 355/259; 118/688

[58] Field of Search ..... 355/203, 208, 209, 245, 355/246, 259, 299; 118/651, 653, 656, 657, 658, 688–691

[56] References Cited

U.S. PATENT DOCUMENTS

| | | | |
|---|---|---|---|
| 4,518,248 | 5/1985 | Nishikawa | 355/299 |
| 4,615,606 | 10/1986 | Nishikawa | 118/657 |

FOREIGN PATENT DOCUMENTS

| | | |
|---|---|---|
| 56-151960 | 11/1981 | Japan . |
| 59-34563 | 2/1984 | Japan . |
| 59-51355 | 4/1984 | Japan . |
| 59-51356 | 4/1984 | Japan . |
| 59-51357 | 4/1984 | Japan . |
| 60-14277 | 5/1985 | Japan . |
| 61-99169 | 6/1986 | Japan . |

*Primary Examiner*—A. T. Grimley
*Assistant Examiner*—E. Pipala
*Attorney, Agent, or Firm*—Burns, Doane, Swecker & Mathis

[57] ABSTRACT

A toner supply device including a hopper for containing the toner; a toner supply roller rotatably disposed below the hopper so as to fill an opening formed in a lower section of the hopper; a charging blade which is disposed so as to be in close contact under pressure with the toner supply roller to electrically charge the toner which is transported on the toner supply roller; a toner scraping mechanism having a toner scraping blade arranged at a position located downstream to the charging blade with respect to a rotational direction of the toner supply; a sensor for detecting the toner density; and a control unit for controlling the toner scraping mechanism depending on signals from the sensor so as to make the toner scraping blade move to one of a first position at which it comes in close contact under pressure with the toner supply roller and a second position at which the blade stands apart from the toner supply roller.

When the toner supply roller is driven, a charged toner layer is formed on the peripheral surface of the roller by the charging blade. And the toner scraping blade is positioned at the first position by the control unit in the case of a low density of the toner, so that the charged toner layer thereon may be scraped off to be supplied to the developing device.

12 Claims, 10 Drawing Sheets

TONER SUPPLY DEVICE FOR USE IN IMAGE FORMING APPARATUS

BACKGROUND OF THE INVENTION

1. Field of the invention

The present invention generally relates to a toner supply device for a developing device adapted for an image forming apparatus such as a copying machine, a printer or the like.

2 Description of the related art

Conventionally, there is a type of a toner supply device which comprises a hopper arranged above the developing device for containing toner therein and a toner supply roller disposed at an opening which is formed at a bottom of the hopper so as to fill the opening, the toner supply roller having slotted grooves which are formed on its outer surface as well as in the direction of its axis. In this type of the toner supply device, by rotating the toner supply roller occasionally, the toner in the hopper may be got into the slotted groove while the slotted groove faces the hopper, and the toner in the slotted grooves falls into the developing device when the groove moves to its bottom position.

For example, the device which has been disclosed in the Japanese Laid-open Utility Model Publication No. 59-51355 (1984) has a scraper of an elastic material, whereby the toner accumulated in slotted grooves which are formed on a toner supply roller is scraped out.

Further, another devices have been, respectively, disclosed in the Japanese Laid-open Utility Model Publication Nos. 59-51356 (1984) and 59-51357 (1984). These device have a brush, whereby the toner accumulated in slotted grooves which are formed on a toner supply roller is brushed off.

Further, another device has disclosed in the Japanese Laid-open Utility Model Publication No. 60-14277 (1985). The device has a toner supply roller on which slotted grooves for supplying toner are intermittently formed along the longitudinal direction of the roller, and a regulating blade for preventing unnecessary toner from leaking is kept in close contact under pressure with the peripheral surface of the toner supply roller.

However, in the former design that is to utilize the toner supply roller having the slotted grooves, it may happen that the toner to be supplied to the developing device adheres to the grooves and remains therein, or the toner accumulated in the groove falls down all of a lump to the inside of the developing device, thus resulting in that dispersion of the toner accommodated in the developing device becomes worse, so that it may be caused that the toner is not sufficiently charged. In addition to the above, various types of shielding members to be arranged on the peripheral portion and/or shaft end portion of the toner supple roller are required so as to prevent unnecessary toner from leaking to the developing device. As a result of that, it may give rise to complication of the device and increase of power for driving the toner supply roller since shielding by the shielding member can be sufficiently tough because of the slotted grooves on the surface of the roller.

So as to improve these disadvantages and carry out stable supply of the toner, another design has been disclosed. That is to form a thin layer of the toner on a toner supply roller and to scrape off the thin layer and then to supply that to a developing device.

For example, a device disclosed in the Japanese Laid-open Patent Publication No. 59-34563 (1984) includes a toner supply roller made of a magnetic roller. Therefore, the toner particles having magnetism cling to the surface of the roller, and these take the form of a thin layer on the roller. In the device, it is so designed that the thin layer of the toner is scraped off by a scraper and the toner is fallen into a developing device. At this moment, a thickness of the layer of the toner is adjustable by a member for regulating a supplied quantity of the toner.

Another type of a device has been disclosed in the Japanese Laid-open Patent Publication No. 56-151960 (1981). In this device, a toner supply roller has minute concave and convex portions on its surface. A layer of a developer formed thereon is brushed off by a brush-shape member, and then the developer is supplied into a developing device.

In these types of the devices, however, there are another disadvantages. That is, the toner or the developer is to be dispersed and charged in the developing device by agitation after the toner is fallen down and supplied to the developing device. Accordingly, it may give rise to unsufficiently charging of the toner or the developer, or something like that.

In order to improve the above-mentioned disadvantages, another type of a device is disclosed which is designed in such way that a pre-discharged toner layer is formed on a toner supply roller and the layer is made to scrape off and, then, the toner is supplied into a developing device.

For example, this type of a device disclosed in the Japanese Laid-open Utility Model Publication No. 61-99169 (1986) is designed as follows. The device has a charging blade and a scraping blade, both blades being kept in close contact under pressure with a toner supply roller, wherein toner is pre-charged by contact with a friction between the charging blade and the toner as well as the toner is fallen down into a developing device by the scraping blade. In this toner supply device, however, the toner passed through the charging blade once is immediately scraped off by the scraping blade. Therefore, it is not always to obtain the result that pre-charging of the toner can be made enough.

Generally, in the developing device, the toner is not always consumed uniformly along the direction of the width of a developing section since, normally, a size of an original document image is different and density of that is not uniform. Therefore, in the toner supply device described previously, it may happen that the toner is supplied to the developing section in which the toner is not required, thus resulting in that it may happen that image density does not become uniform.

In addition, the conventional type of the toner supply devices described previously have the below-mentioned disadvantage caused by these structure. That is, the toner supply roller is triboelectrically charged when it rotates under the condition that the roller is kept in contact with the scraping blade and so on, and then, the charge is accumulated on the peripheral surface of the roller. As a result of that, electrification of the toner given by contact having friction with the charging blade becomes low, and scraping efficiency by the scraping blade becomes worse as well, so that there happens a problem that the toner is not uniformly supplied.

SUMMARY OF THE INVENTION

Accordingly, an essential object of the present invention is to provide an improved toner supply device which can overcome such disadvantages as described above and which is capable of supplying toner which is sufficiently pre-charged as well as properly dispersed into a developing device.

A further object of the present invention is to provide an improved toner supply device which has a simple structure and easy control as well as is capable of uniforming image density by efficiently supplying the toner.

A further object of the present invention is to provide an improved toner supply device which is capable of preventing accumulation of a charge in a toner supply roller as well as is capable of uniformly supplying toner.

In accomplishing these and other objects, according to one preferred embodiment of the present invention, there is provided an improved toner supply device attached to a developing device, for use in an image forming apparatus, for developing a latent image on an electrostatic latent image support member by supplying toner to the latent image, which comprises: a hopper for containing the toner; a toner supply roller rotatably disposed below the hopper so as to fill an opening formed in a lower section of the hopper, the toner supply roller being simultaneously driven at the time when the developing device is driven; a charging blade disposed so as to be in close contact under pressure with a peripheral surface of the toner supply roller to electrically charge the toner which is transported on the toner supply roller, so that a predetermined thickness of a toner layer is formed on the peripheral surface thereof; toner scraping means arranged at a position located downstream to the charging blade with respect to a rotational direction of the toner supply roller, by which the toner layer on the toner supply roller may be scraped off to be supplied to the developing device; detecting means for detecting toner density; and control means for controlling the toner scraping means depending on signals from the detecting means so as to make the toner scraping means remove to one of a first position at which the toner scraping means comes in close contact under pressure with the toner supply roller and a second position at which the toner scraping means stands apart from the toner supply roller.

The toner supply roller rotates simultaneously with a main motor of the developing device when the main motor is driven. During the time when the toner supply roller rotates, the toner on the peripheral surface of the toner supply roller is transported in the rotating direction of the toner supply roller, and the toner acquires a charge by contact having friction with the charging blade on the occasion of passing the gap between the charging blade and the toner supply roller as well as the toner takes the shape of a layer with a certain thickness. Then, the charged toner layer is clinged to the surface of the roller and transported while facing the inside of the developing device.

When control means turns toner scraping means on depending on a signal generated from detecting means of the toner density, the toner scraping means scrapes the charged toner layer off the toner supply roller continuously by turns and supplies the charged toner into the developing device. At this time, the toner on the toner supply roller remains charged as well as is formed in the shape of the layer with a certain thickness, so that the toner is continuously supplied to the developing device with proper dispersion at the rate of a certain amount.

In addition, the charged toner layer having a certain thickness as previously described is formed on the peripheral surface of the toner supply roller since the toner supply roller rotates as far as the main motor is driven even if control means turns toner scraping means off depending on a signal of stopping toner-supply by detecting means of the toner density. Therefore, if a signal of starting toner-supply is generated again after the signal of stopping toner-supply is generated, the toner which is formed in the shape of a layer with a certain thickness and with sufficiently charged state is to be supplied.

As it is apparent from the above-mentioned description, according to the present invention, the charged toner layer is always formed as far as the main motor is running even though the signal of starting toner-supply is not generated, so that there is no possibility that unsufficiently charged toner is supplied to the developing device with improper dispersion of the toner even when the signal of starting toner-supply is generated and then toner-supply may start. Accordingly, the present invention has an advantage capable of obtaining a copied fine image without image faults such as cracking of an image due to lack of the toner, fog and non-uniformity.

BRIEF DESCRIPTION OF THE DRAWINGS

These and other objects and features of the present invention will become apparent from the following description taken in conjunction with the preferred embodiments thereof with reference to the accompanying drawings, in which.

DETAILED DESCRIPTION OF THE INVENTION

Figure 1:
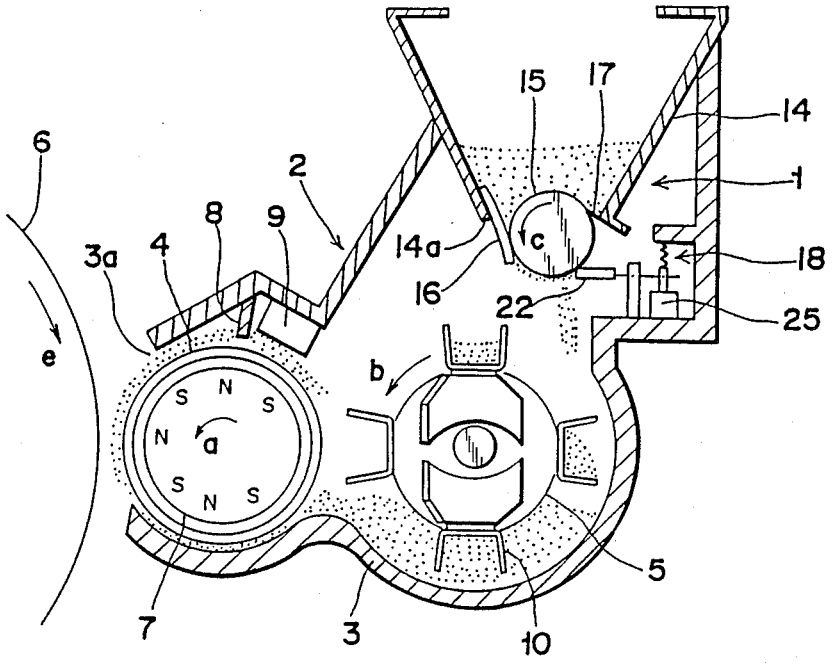
FIG. 1 is a sectional view of a developing device including a toner supply device according to a preferred embodiment of the present invention.

Before the description of the present invention proceeds, it is to be noted that like parts are designated by like reference numerals and symbols throughout the several views of the accompanying drawings.

Figure 2:
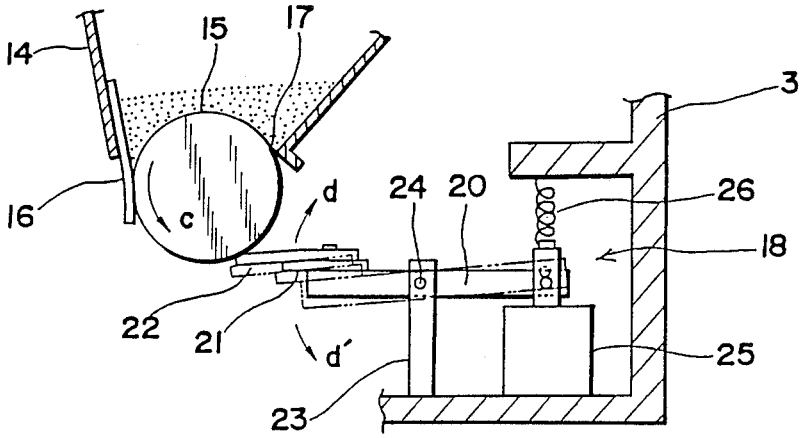
FIG. 2 is a sectional view showing a toner scraping mechanism of the toner supply device according to the first embodiment.
Figure 3:
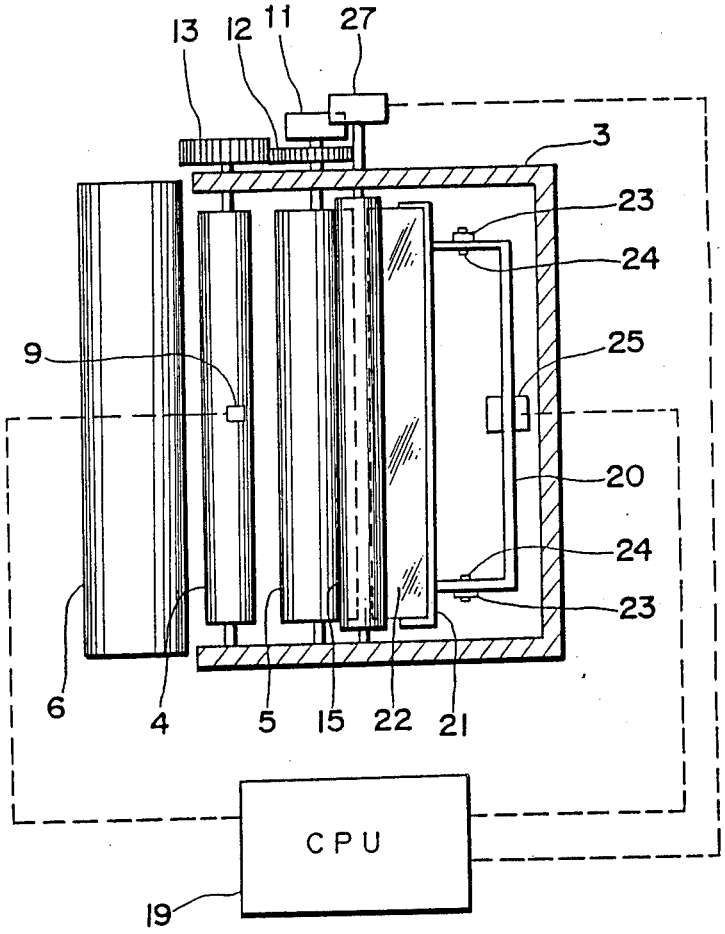
FIG. 3 is a plane view of the developing device shown in FIG. 1.

Referring now to the drawings of FIGS. 1, 2 and 3, there are shown a developing device 2 including a toner supply device 1 according to a first embodiment of the present invention. The developing device 2 has a developing tank 3 in which a developing sleeve 4 and a bucket roller 5 are provided. The developing sleeve 4 is arranged so as to fill an opening 3*a*, which is formed in the developing tank 3, from the inside of the tank 3 thereby and is rotatably supported so as to rotate in the direction shown by an arrow (a). The developing sleeve 4 is so designed that some portion of the sleeve 4 protrudes from the opening 3*a* so as to confront a photosensitive drum 6 with a predetermined gap between its protruding portion and the photosensitive drum 6. In addition, a magnetic roller 7 is stationarily disposed inside the developing sleeve 4 and is internally provided with a plurality of magnets disposed along its peripheral portion, these positive poles N and negative poles S alternating with each other and each magnet extending in parallel relationship with its central axis. And arrangement of the magnets is so designed that any one of these magnets is located so as to be closer to the photosensitive drum 6 as well as another magnet having same polarity as that of the above-mentioned magnet is disposed at the confronting portion of the sleeve 4 being closer to the bucket roller 5.

There is provided a stationary regulating blade member 8 fixed on the internal surface of the developing tank wall above the developing sleeve 4 so as to confront the sleeve 4, the stationary regulating blade member 8 extending in parallel with the axis of the sleeve 4, further, the predetermined gap being provided therebetween. Furthermore, a sensor 9 for detecting toner density is attached on the internal surface of the developing tank, a position of the sensor 9 being a more upstream side along the rotating direction of the sleeve 4 than that of the blade member 8.

The above-mentioned bucket roller 5 mounts a plurality of buckets 10 on its peripheral portion, each bucket 10 extending in the longitudinal direction of the roller 5. The bucket roller 5 is located on the opposite side of the photosensitive drum 6 beyond the developing sleeve 4 and is arranged in parallel with the sleeve 4. Moreover, the bucket roller 5 is supported rotatably in the direction shown by an arrow (b). This bucket roller 5 is driven by a first motor 11 as shown in FIG. 3, and the above-mentioned developing sleeve 4 is driven by the same motor 11 through gears 12, 13 as well.

The toner supply device described previously comprises a toner hopper 14, a toner supply roller 15, a charging blade 16, a seal-blade 17, a toner scraping mechanism 18 and a control unit 19. The toner hopper 14 is a hopper in which toner is contained and is arranged so as to be located above the developing tank 3 as well as above the bucket roller 5.

The toner supply roller 15 is arranged so as to fill an opening 14*a* which is formed at the bottom of the hopper 14 and is supported rotatably in the direction shown by an arrow (c). It is also so designed that a lower half of the peripheral surface of the toner supply roller 15 protrudes into the inside of the developing tank 3 and an upper half of that becomes in contact with the toner in the hopper 14.

The charging blade 16 is fixed at one side of the edge portion of the opening 14*a* at the bottom of the hopper 14, the blade 16 being so arranged that it extends along the rotating direction of the toner supply roller 15 shown by an arrow (c) and its lower end portion comes in close contact under pressure with the toner supply roller 15.

The seal-blade 17 is so arranged that its one end is fixed at the other side of the edge portion of the above-mentioned opening 14*a* and it extends along the rotating direction of the toner supply roller 15 and the other end of it comes in close contact under pressure with the toner supply roller 15.

Accordingly, the opening 14*a* at the bottom of the hopper 14 is to be filled by the toner supply roller 15, the charging blade 16 and the seal-blade 17.

The abovedescribed toner scraping mechanism 18 is arranged in a space formed diagonally below the toner supply roller. As shown in FIGS. 2 and 3, The toner scraping mechanism 18 comprises a U-shape frame member 20, a blade holder 21 which is bridged between both ends of the frame member 20, a toner scraping blade 22 disposed between the charging blade 16 and the seal-blade 17 and stationarily mounted on the blade holder 21, a pair of supporting members 23 stationarily disposed inside the developing tank 3 for swingably supporting the frame member 20 through pins 23, a solenoid 25 and a coil spring 26 which are engaged with the frame member 20 at the middle portion thereof to urge the scraping blade 22 against the toner supply roller 15. When the solenoid is activated, the front end of the scraping blade 22 turns in the direction shown by an arrow (d) in FIG. 2, then, it comes in close contact under pressure with the toner supply roller 15, just as shown with a solid line. That is, the blade 22 stands at a first position. When the solenoid 25 is disactivated, its front end turns in the direction shown by an arrow (d') in FIG. 2 by means of the force of the coil spring 26, then, the front end is apart from the toner supply roller 15, just as shown with a line with two dots. That is, the blade 22 stands at a second position.

The control unit 19 is so designed that it controls a second motor 27 by which the toner supply roller 15 is driven and controls activation of the solenoid 25 of the toner scraping mechanism 18 depending on the signal of starting toner-supply or of stopping toner-supply generated by the sensor 9 of the toner density previously described.

In the developing device having the structure described above, the developing device employs a two-components developer comprising toner and carrier. Before operation of the device, it is assumed that the following preparation has been made. That is, the developer of which a quantity is predetermined is contained in the developing tank 3 and the supplementary toner is contained in the hopper 14 as well.

Under these conditions, when a main switch for starting printing is turned on, a main motor (not shown) is driven and, then, the photosensitive drum 6 rotates in the direction shown by an arrow (e) in FIG. 1 through the main motor. At the same time, the first and second motors 11, 12 are driven and the developing sleeve 4, the bucket roller 5 and the toner supply roller 15 rotate in the direction shown by arrows (a), (b) and (c), respectively. In the inside of the developing tank 3, whereby, the developer which is scooped up by the bucket 10 of the bucket roller 5 rotating in the direction shown by an arrow (b) is discharged to the developing sleeve 4. And the carrier in the developer which is supplied onto the outer surface of the developing sleeve 4 is attracted and clinged thereto by means of the magnetic force of the magnetic roller 7 and is transported with the toner in the direction shown by an arrow (a).

The developer on the developing sleeve 4 is electrically charged as follows. At first, the quantity of the developer to be transported is regulated by the stationary regulating blade member 8. Next, the developer dammed up by the blade member 8 joins the succeeding developer in the spacing behind the blade member 8, both developer being mixed up with each other like a turbulence in the spacing. Thus, the toner and carrier are mixed up and stirred, resulting in that the toner acquires a charge of the positive polarity and the carrier acquires a charge of the negative polarity. It is to be noted that the toner density in the developer is detected by the sensor 9 of the toner density here.

The developer which passed through the stationary regulating blade member 8 is transported at the state of "magnetic-brush" in the direction shown by an arrow (a) and the toner and carrier are further mixed and agitated under the influence of the alternating magnetic force on the occasion of passing the portions facing the respective magnets, thus resulting in that the developer becomes sufficiently charged to the state capable of the development.

Thus, when the developer reaches the confronting portion to the bucket roller 5 after rounding about the circumference of the developing sleeve 4, the developer loses its magnetically holding force and, then, the developer is collected in the developing tank 3 located on the side of the bucket roller 5. In the inside of this tank 3, the toner and carrier are mixed and agitated by operation of the bucket roller 5 of which the buckets 10 are rotated in the direction shown by an arrow (b).

On one hand, in the inside of the toner hopper, the toner brought into contact with the toner supply roller 15 is transported in the direction shown by an arrow (c) with the rotation in the direction shown by an arrow (c) of the toner supply roller 15. On the occasion of passing through the spacing between the charging blade 16 and the toner supply roller 15, the toner becomes charged triboelectrically to the positive polarity. At the same time, the toner takes the form of a layer having a certain thickness. This charged toner layer is transported in the direction shown by an arrow (c) on the toner supply roller 15. When the toner scraping mechanism 18 is in off-state, the toner passes the mechanism 18 and return to the inside of the toner hopper 14 through the seal-blade 17. After that, further charging of the toner is repeatedly carried out by passing through the charging blade 16, as mentioned above. Thus, the toner retained on the toner supply roller 15 rounds repeatedly until the toner scraping mechanism 18 becomes into the on-state while acquiring sufficient pre-charge at every passing through the charging blade 16.

Under the above-mentioned conditions, scanning to the original image of the document is carried out. And the electrostatic latent image of the original image is formed on the surface of the photosensitive drum 6. After that, when the latent image moves to the portion confronting the developing sleeve 4, the latent image is developed by brushing of the developer of which the magnetic-brush is formed on the developing sleeve 4. The toner is consumed by this developing operation and the toner density becomes low. When the toner density becomes low, the sensor 9 detects it and outputs a signal of starting toner-supply to the control unit 19.

Figure 4:
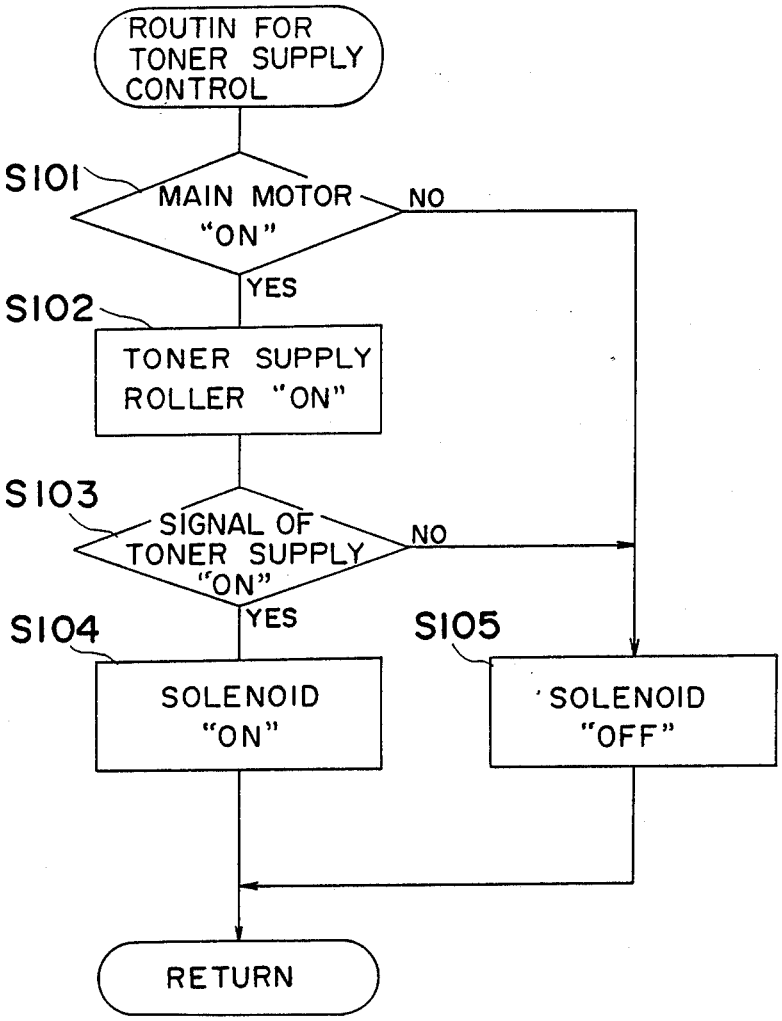
FIGS. 4 and 5 are, respectively, diagrams of a flow chart and of a time chart showing a control for toner supply in the above-mentioned developing device
Figure 5:
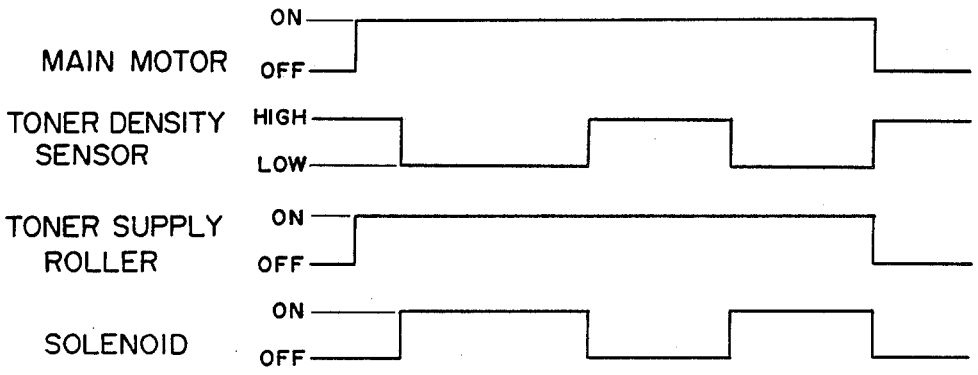

Referring now to FIGS. 4 and 5, there are shown a flow chart and a time chart for explaining the operation of toner-supply of the first embodiment, respectively. The operation is explained hereinbelow.

In FIG. 4, it is decided at step S101 whether or not the main motor is running. When the main motor is running, the program advances to step S102 and the toner supply roller 15 is caused to be driven at step S102. By the steps of step S101 and S102, the charged toner layer having a certain thickness is formed on the toner supply roller 15, as previously described. Meanwhile, when it is decided at step S101 that the main motor is not driven, the program goes to step S105, and at step S105, it makes the solenoid 25 turn off and the program returns.

Next, At step S103, it is decided whether or not the signal of starting toner-supply is generated, i.e., whether or not the sensor 9 detects that the toner density is low. When decided at step S103 that the signal is "ON", it makes the solenoid 25 turn on at step S104. Whereby, the frame 20 engaged with the solenoid 25 moves in the direction shown by an arrow (d), and the front end of the toner scraping blade 22 is brought into close contact under pressure with the toner supply roller 15. In other words, the blade 22 stands at the first position. Consequently, the charged toner layer described above is scraped off the toner supply roller 15 and then, is supplied to the inside of the developing tank 3, as shown in FIG. 1. At this moment, since the toner on the roller 15 is a charged toner as well as is in the shape of a layer having a certain thickness, it is possible to continuously supply the toner to the developing tank 3 with proper dispersion at the rate of a certain quantity.

The supplied toner is supplied on the developing sleeve 4 by the bucket roller 5, as previously described, and is transported to the portion confronting the photosensitive drum 6 and is provided for the development. In this case, the toner has been pre-charged and is supplied with proper dispersion to the developing sleeve 4, so that there is no possibility that unsufficiently charging and improper dispersion are caused on the developing sleeve 4 as far as the toner is concerned. Accordingly, it is possible to obtain a printed fine image with uniformity and non-fog as well as without lack of the developer.

Meanwhile, when the toner density on the developing sleeve 4 becomes high by supplying the toner thereto, the sensor 9 for detecting the toner density detects the high density and outputs the signal of stopping toner-supply to the control unit 19.

When the above-mentioned signal is outputted,. it makes the solenoid 25 turn off at step S105, and the program returns since the signal of starting toner-supply is not available at step S103, i.e. "OFF". Whereby, the front end of the toner scraping blade 22 moves away from the toner supply roller 15 since the frame 20 of the toner scraping mechanism 18 moves back in the direction shown by an arrow (d') by means of the coil spring 26. In other words, the blade 22 stands at the second position. Therefore, the charged toner layer on the toner supply roller 15 is retained thereon and is transported in the direction shown by an arrow (c). Then, the further pre-charging to the toner layer is carried out by the charging blade 16, and the charged toner layer goes around repeatedly until the solenoid 25 is turned on.

The toner layer is not scraped off when the toner density is sufficient for the development. So, as far as the toner supply roller 15 is driven as well as the main motor is driven, there is no possibility that unsufficiently charging and improper dispersion of the toner are caused in the case where the signal of starting toner-supply is outputted afterward. That is, the toner supply device according to this embodiment is capable of preventing the toner from being charged unsufficiently and being dispersed ununiformly as far as the main motor is driven.

It is to be noted here that the toner in the above-mentioned embodiment is not scraped off the toner supply roller until the solenoid 25 is turned on afterward due to the low density of the toner, in other words, the signal of starting toner-supply is outputted. However, there is another way available for preventing imperfectly charging of the toner. A second embodiment of the present invention is disclosed hereinbelow.

A toner supply device according to the second embodiment of the present invention comprises a toner hopper 14, a toner supply roller 15, a charging blade 16, a toner scraping mechanism 18, a sensor 9 for detecting toner density and a control unit 19 which are completely identical with the respective components of the toner supply device, shown in FIGS. 1 to 3, in the first embodiment. And this toner supply device is provided for the developing device described in the first embodiment, as shown in FIG. 1.

As compared between the first and second embodiments, the method of the control for the toner scraping mechanism by the control unit 19 differs from that of the first embodiment. That is, the control unit 19 makes the solenoid 25 turn on when the toner on the toner supply roller 15 has passed through the charging blade 16 not less than twice and, after that, the control unit 19 makes the solenoid 25 turn off when the toner supply roller 15 turns once. Accordingly, pre-charged toner is always scraped off and supplied, so that imperfectly charging may be prevented. Therefore, a detailed explanation about the same portion, i.e., the structure of the developing device and the toner supply device, is omitted here.

Figure 6:
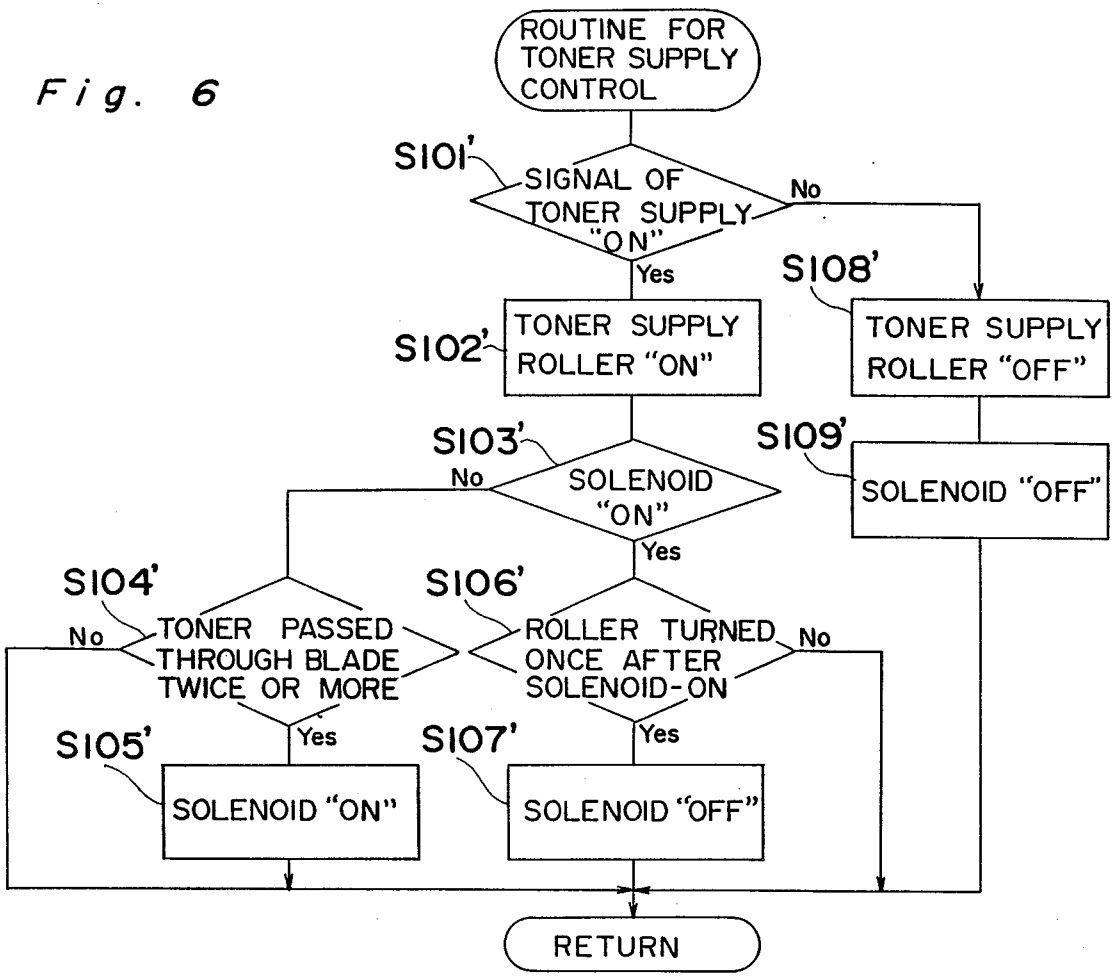

Referring now to FIG. 6, there is shown a control routine carried out by the control unit 19. At step S101', it is decided whether or not a signal of starting toner-supply is on, in other words, the sensor 9 for detecting the toner density detects low density of the toner or not. When decided at step S101' that the signal is on, i.e., the density is low, then the control unit 19 makes the toner supply roller 15 driven through the second motor 27 at step S102'. Whereby, the toner acquires a charge of the positive polarity and takes the shape of a layer as described in the first embodiment.

Next, it is decided at step S103' whether or not the solenoid 25 is activated. When decided at step S103' that the solenoid is disactivated, then the program advances to step S104' and it is decided at step S104' whether or not the toner on the toner supply roller 15 has passed through the charging blade 16 not less than twice. When decided at step S104' that the toner has not yet passed through the blade 16 not less than twice, the program returns. Whereby, even if the above-mentioned signal is under the ON-state, the solenoid 25 is controlled so as to keep the OFF-state until the toner passes through the charging blade 16 not less than twice.

On one hand, when it is decided at step S104' that the toner on the roller 15 has already passed through the charging blade 16 not less than twice, the program advances to step S105' and the solenoid 25 is turned on at step S105'. When the solenoid 25 is activated, the front end of the toner scraping blade 22 moves in the direction shown by an arrow (d) and is brought into close contact under pressure with the toner supply roller 15, as described in the first embodiment. As a result of that, the toner is scraped off the toner supply roller 15 and supplied into the developing tank 3. A toner condition at this stage is completely same as that of step 104 of the first embodiment. During the operation of this toner-supply, it is decided at step S106' whether or not the toner supply roller 15 turns once after the solenoid 25 has been turned on because it is detected at step S103' that the solenoid 25 was turned on. When decided at step S106' that the roller 15 has not turned completely once since then, the program returns and the operation of toner-supply is continued.

When decided at step S106' that the roller 15 has already turned once, the solenoid 25 is turned off at step S107'. Whereby, the front end of the scraping blade 22 moves away from the toner supply roller 15, as described in the first embodiment. Accordingly, the toner clinging to the outer surface of the roller 15 is transported in the direction shown by an arrow (c) without scraping and is further charged by the charging blade 16.

When the toner on the toner supply roller 15 has passed through the charging blade 16 not less than twice, the control unit 19 gets that information at step S104' and, then, it makes the solenoid 25 turn on at step S105' again. When turning the solenoid 25 on, the operation of toner-supply starts. Whereby, the toner of which the quantity is equivalent to that of the toner on the whole surface of the toner supply roller 15 as well as which has already passed through the charging blade 16 not less than two times and has been sufficiently pre-charged is scraped off the roller 15 and is supplied into the developing tank 3.

Figure 7:
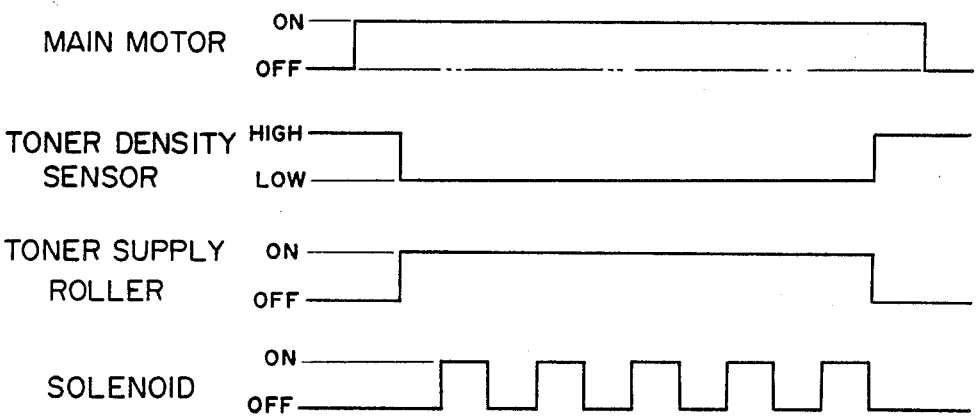
FIGS. 6 and 7 are, respectively, diagrams of flow chart and of a time chart for controlling a toner supply device of a developing device according to a second embodiment which is applicable to the present invention.

The operation of toner-supply mentioned above is carried out at regular intervals, as shown in FIG. 7, because the solenoid 25 is repeatedly turned on and off at predetermined periods while the signal of starting toner-supply outputted from the sensor 9 is available.

The supplied toner is provided onto the developing sleeve 4 with bucket roller 5 as same as the first embodiment does. In this embodiment, the toner supplied to the developing tank 3 is sufficiently charged since the toner has passed through the charging blade 16, at least, twice and is provided onto the developing sleeve 4 with proper dispersion as same as the first embodiment does, so that it is possible to obtain a printed fine image with uniformity and non-fog as well as without lack of the developer.

On one hand, when the density of the toner on the developing sleeve 4 becomes high due to supplement of the toner thereto, the sensor 9 detects it and outputs the signal of stopping toner-supply to the control unit 19. Then, as the signal of starting toner-supply is off, the program goes to step S108' through step S101'. At step S108', driving of the toner supply roller 15 is made to stop and at step S109', the solenoid 25 is made to be turned off, and then the program returns.

In this embodiment, it is so designed that the toner supply roller 15 is drived and the solenoid 25 is turned on to supply the toner while the signal of starting toner-supply is outputted, i.e., the sensor 9 detects that the toner density is low, regardless of the in- or out-of-operation of the main motor. Therefore, if the sensor 9 outputs the signal of starting toner-supply, this toner supply device is capable of supplying toner even in such a case that the main motor is made to stop without any additional supplement of the toner to the developing sleeve 4 under the condition that the toner density decreases by copying a document with a high contrast. Accordingly, on the next occasion of copying, the toner density has been regained, so that it is possible to obtain a printed image with proper density.

As it is apparent from the above-mentioned discreptions, it is not necessary by all means that the toner supply roller 15 is always driven by the main motor in this embodiment although the toner supply roller in the first embodiment is always driven by the main motor.

Generally, the consumption of the toner consumed along the longitudinal direction of the developing sleeve is not even by all means because of difference of the size or discrepancy of the density of the original image and so on. Therefore, it is desirable to the developing device that the toner is supplied, at least, to a section where the supplementary toner is required. The following embodiment is an example of a developing device having a toner supply device which satisfies with the above-mentioned function.

The example having a toner supply device disclosed as a third embodiment of the present invention is a developing device similar to the developing device shown in FIGS. 1 and 2. However, so as to accomplish that purpose, the toner supply device has toner scraping means divided into several portions, which are, respectively, arranged along the longitudinal direction of a toner supply roller so as to correspond to a plurality of detecting means for detecting toner density. That is, the third embodiment is a toner supply device capable of supplying the toner to a portion where the supplementary toner is required.

Figure 8:
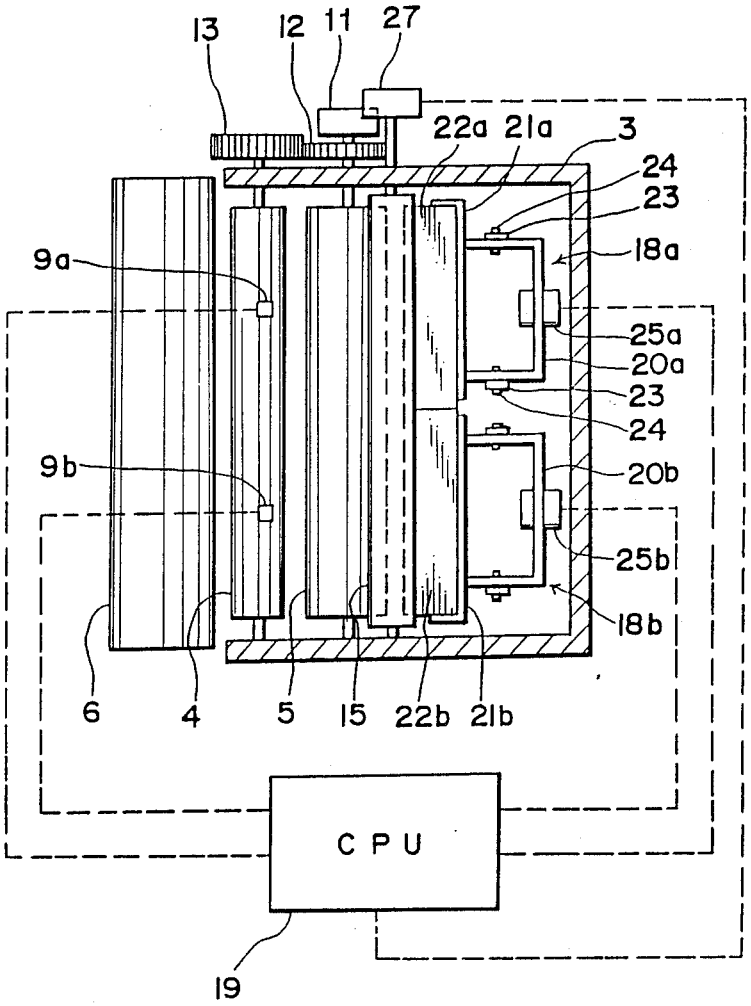
FIG. 8 is a plane view of a developing device involving a toner supply device shown as a third embodiment which is applicable to the present invention.

Referring now to FIG. 8, there is shown a toner supply device according to the third embodiment of the present invention. The device comprises a toner hopper 14 (not shown), a toner supply roller 15, a charging blade 16 (not shown), a pair of toner scraping mechanisms 18*a*, 18*b*, a pair of sensors 9*a*, 9*b* for detecting toner density and a control unit 19 which are completely identical with the respective components of the toner supply device disclosed in the first embodiment (FIGS. 1, 2 and 3) except the toner scraping means 18*a*, 18*b*. And this toner supply device is provided for the developing device disclosed in the first embodiment, as shown in FIG. 1. Each toner scraping means 18*a*, 18*b* is designed as same as means disclosed in the first embodiment. The differences between the two are just sizes of the component members, i.e., a size of each mechanism is equivalent to a half size of that of the first embodiment. So, explanation about its structure is omitted here (refer to it in the first embodiment).

As previously described, each toner scraping means, i.e., a first toner scraping mechanism 18*a* and a second toner scraping mechanism 18*b*, is arranged along the longitudinal direction of the toner supply roller 15 and the first and second toner scraping mechanisms 18*a*, 18*b* are independently controlled by the control unit 19. That is, a first and second toner scraping blades 22*a*, 22*b* are located side by side and are independently swung by the corresponding solenoids 25*a*, 25*b* and coil springs (not shown) through the control unit 19. Both sensors 9*a*, 9*b* are, respectively, arranged at corresponding positions to the first and second toner scraping mechanisms 18*a*, 18*b* so as to detect density of the toner corresponding to every half of the developing sleeve 4.

The control unit 19 is so designed that it controls driving of the second motor 27 by which the toner supply roller 15 is driven as well as it makes the first and second solenoids 25*a*, 25*b* independently turn on or off depending on a signal of starting toner-supply and stopping toner-supply generated from the first and second sensors 9*a*, 9*b*. The control procedure by the control unit 19 is completely same as that of the second embodiment. In addition, the respective toner scraping mechanisms 18*a*, 18*b* are independently controlled by the control unit 19. That means movement of the first toner scraping mechanism 18*a* by the first solenoid 25*a* is controlled depending on the signal outputted from the first sensor 9*a* and movement of the second toner scraping mechanism 18*b* by the second solenoid 25*b* is controlled depending on the signal outputted from the second sensor 9*b*.

It is to be noted that reference numerals 3, 5, 6, and 11 designate the developing tank, the bucket roller, the photosensitive drum and the first motor, respectively. Further reference numerals 12 and 13 designate gears, respectively, and reference numerals 20*a*; 20*b*, 21*a*; 21*b*, 23 and 24 designate first and second U-shape frames, first and second blade holders, a support member and a pin, respectively.

Thus, the toner supply device of this embodiment is capable of supplying the sufficient charged toner to either of the two sections into which the peripheral surface of the developing sleeve 4 is divided, either of the two sections requiring the supplementary toner due to the low density of the toner. Of course, the supplementary toner can be supplied to both sections at the same time. It depends on the degree of the consumption of the toner on the developing sleeve 4.

Furthermore, the control procedure carried out in the first embodiment is applicable to the above-mentioned toner supply device as well. Regardless of the difference of the control procedure, this embodiment achieves the aims as the previous embodiments do.

In a type of the toner supply devices with a toner scraping blade, it may be taken into consideration that the peripheral portion of the toner supply roller becomes charged triboelectrically by close contact with a toner scraping blade. This phenomenon causes electrification of the toner decrease and causes efficiency of scraping the toner by a toner scraping blade low. As a result of that, stable toner-supply can not be accomplished. In order to avoid such problems, the following embodiment is disclosed as a forth embodiment of the present invention.

Figure 9:
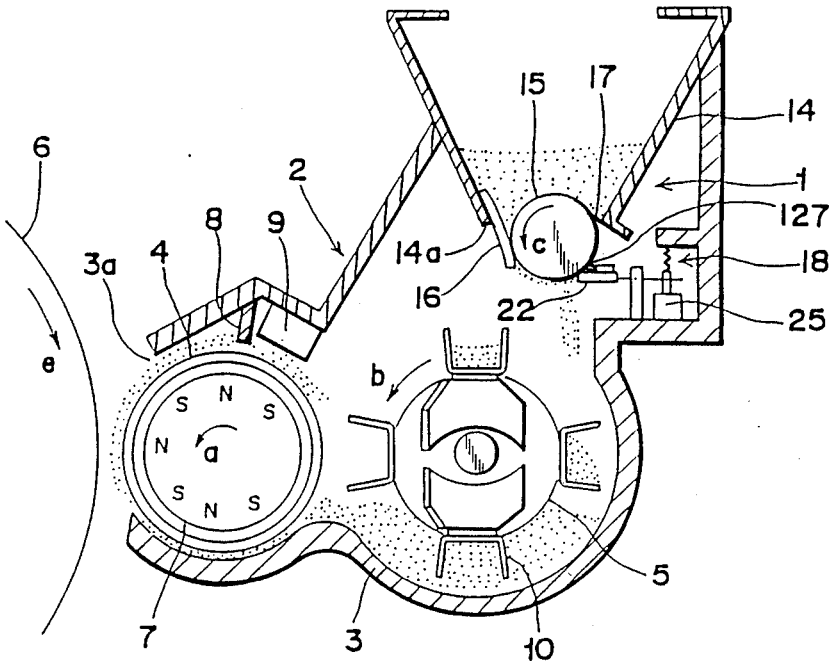
FIG. 9 is a sectional view of a developing device including a toner supply device shown as a fourth embodiment which is applicable to the present invention.

Referring now to FIG. 9, there is shown a developing device providing a toner supply device according to the forth embodiment of the present invention. It is to be noted here that structures and arrangements of numbers and elements composing the developing device are almost same as these of the first embodiment described previously. Difference between both developing devices is just whether or not to provide members for taking an electric charge away from a toner supply roller in the toner supply device. So, in this embodiment, the different portions in the toner supply device are described in details, and the others must be referred to the descriptions in the first embodiment.

In FIG. 9, the developing device 2 comprises a developing sleeve 4, a bucket roller 5 and a developing tank 3 in which both members 4, 5 are respectively disposed, and a toner supply device 1 is attached to the upper portion of the tank 3. Thus, the main arrangement is completely same as that of the first embodiment. Reference numerals 6, 7, 8, 9 and 10 designate a photosensitive drum, a magnetic roller, a stationary regulating blade member, a sensor and a plurality of buckets. These members designated by the reference numerals 3 to 10 have same structure and same function as those of the first embodiment, respectively.

The above-mentioned toner supply device 1 comprises a toner hopper 14, a toner supply roller 15, a charging blade 16 and a toner scraping mechanism 18. These members have same structure and same function as those of the first embodiment, respectively. Further, the device 1 has a electric charge eliminating means 127 and a control unit 19 (not shown). This charge eliminating means comprises a brush-shape member 127 of a material with electrical conductivity and a base plate 28 supported by the toner scraping mechanism 18, the brush-shape member 127 being supported on the base plate 28 and the base plate 28 being electrically grounded.

Figure 10:
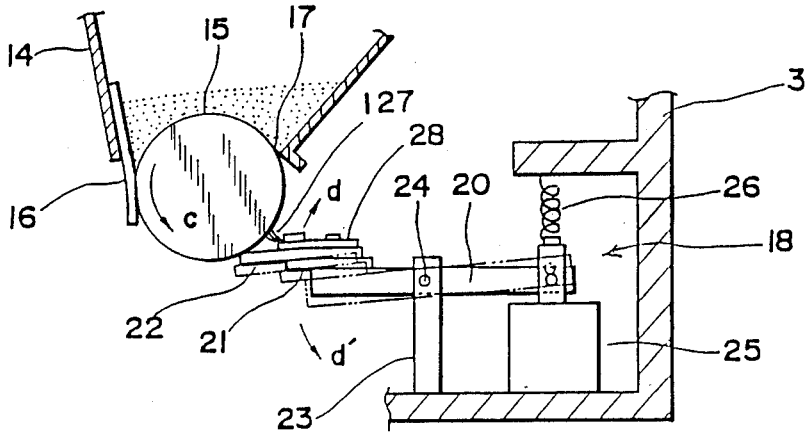
FIG. 10 is a sectional view of a toner scraping mechanism of the toner supply device shown in FIG. 9.

Referring now to FIG. 10, there is shown the toner supply device 1 described above. Difference between the device 1 of this embodiment and that of the first embodiment is that this device 1 shown in FIG. 10 provides the charge eliminating means 127, 28 while the former device shown in FIG. 2 has not that means. As can be seen from drawings, other members and/or structure are completely same. Therefore, the detailed descriptions about the respective members and/or structures are omitted here, assuming that the descriptions must be referred to those of the previous embodiment. Incidentally, reference numerals 16, 17, 20, 21, 22, 23, 24, 25 and 26 designate a charging blade, a seal-blade, a U-shape frame, a blade holder, a toner scraping blade, a support member, a solenoid and a coil spring, respectively. Furthermore, it is to be noted that the structure of the toner scraping mechanism 18 disclosed in the third embodiment may be applicable to that of this embodiment.

The above-mentioned brush-shape member 127 is so arranged that the brush-shape member 127 comes in close contact under pressure with the toner supply roller 15 at the position located along its rotating direction as well as being downstream than the contact position of the toner scraping blade 22 with the toner supply roller 15 when the solenoid 25 is turned on. So, the front end of the toner scraping blade 22 moves in the direction shown by an arrow (d) in FIG. 10 when the solenoid 25 is turned on, and the front end comes in close contact under pressure with the roller 15. At the same time, the brush-shape member 127 moves in the same direction and is brought into close contact under pressure with the roller 15 on the downstream side of the rotating direction of the roller 15, as compared with the contact position of the scraping blade 22. On one hand, when the solenoid 25 is turned off, the scraping blade 22 and the brush-shape member 127 move in the direction shown by an arrow (d') and stand apart from the toner supply roller 15.

Figure 11:
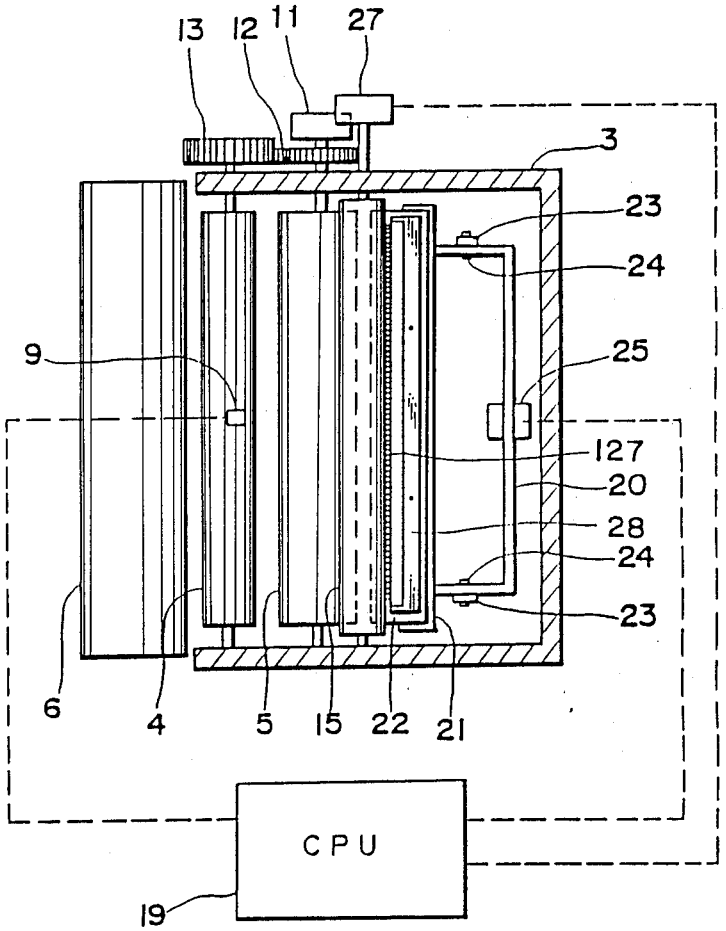
FIG. 11 is a plane view of the developing device in FIG. 9.

Referring now to FIG. 11, there is shown how to control the toner supply device 1 by the control unit 19. As shown in FIG. 11, the control unit 19 controls a second motor 27 by which the toner supply roller 15 is driven as well as controls activation of the solenoid 25 of the toner scraping mechanism 18 depending on the signal of starting toner-supply or of stopping toner-supply generated by the sensor 9 of the toner density. It is to be noted that the bucket roller 5 is driven by a first motor 11 and the above-mentioned developing sleeve 4 is driven by the first motor 11 through gears 12, 13 as well. As to the control procedure of the toner scraping mechanism 18 by the control unit 19, it is same as that of the second embodiment, i.e., the procedure shown in FIGS. 6 and 7. So, the descriptions of the control procedure are omitted here, assuming that these must be referred to those of the former embodiment. Of course, the control procedure of the first embodiment as shown in FIGS. 4 and 5 may be applicable to that of this embodiment. In such case, it is enough to achieve the desired aims of the present invention.

By providing the brush-shape member 127, a charge in the toner supply roller 15 of which the peripheral portion becomes charged triboelectrically by contact of the charging blade 16 and the toner scraping blade 22 can be leaked through the brush-shape member 127 and is eliminated from that portion. Accordingly, it is possible to prevent electrification of the toner from becoming lower and to achieve that efficiency of scraping toner by the toner scraping mechanism is ensured against getting worse.

The above-mentioned embodiments are, respectively, some examples on the present invention. So, there are various modifications applicable to the present invention. Hereinbelow, such modifications are disclosed as further embodiments.

Figure 12:
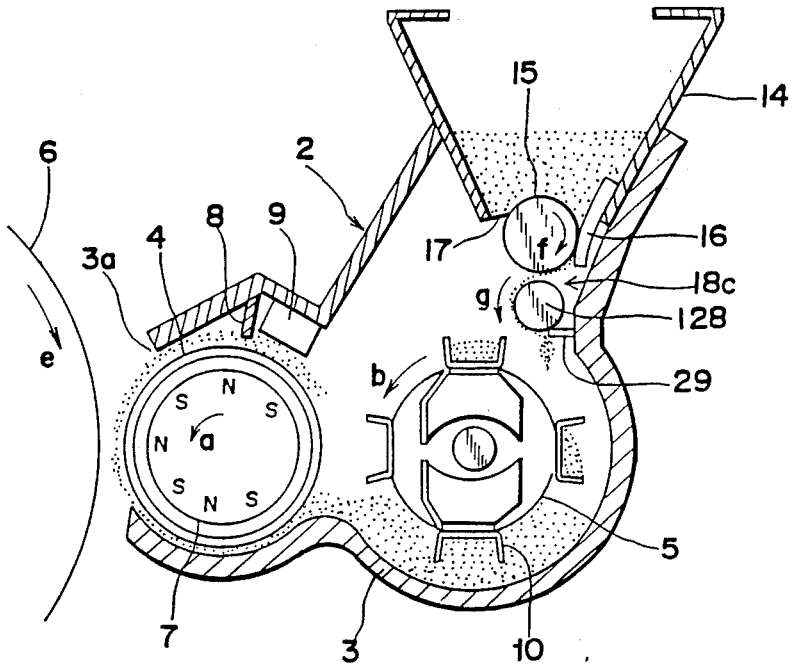
FIG. 12 is a sectional view of another developing device including a toner supply device according to another embodiment which is applicable to the present invention.
Figure 13:
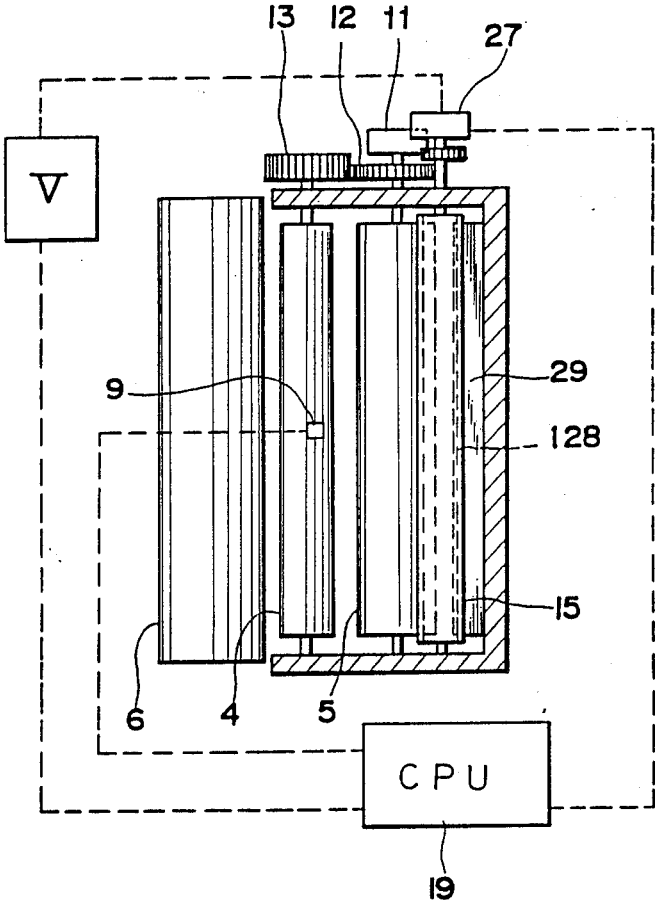
FIG. 13 is a plane view of the developing device shown in FIG. 12.

For instance, although the toner supply devices in the embodiments described above have respectively the toner scraping mechanism which comprises the toner scraping blade 22 and the solenoid 25, and it mechanically functions, there is another way available for stable toner-supply, as shown in FIGS. 12 and 13.

Referring now to FIGS. 12 and 13, there are, respectively, shown developing devices 2 including a toner supply device having electrically scraping method of the toner, i.e., a toner scraping mechanism 18*c*, as a fifth embodiment. The toner scraping mechanism 18*c* comprises means 128 for collecting electrically the toner and means 29 for mechanically scraping such toner. As shown in FIG. 12, there is disposed a roller 128 of a material with electrical conductivity under a toner supply roller 15 in such a way that there exists a predetermined gap between the electrical conductive roller 128 and the toner supply roller 15. The electrical conductive roller 128 is designed to be always driven by a second motor 27 simultaneously with the toner supply roller 15 driven by a first motor 11, as shown in FIG. 13, by all means when a main motor (not shown) is caused to be driven. Furthermore, the toner supply device has a power supply unit V and it is so designed that a negative voltage from the power supply unit V is applied to the electrical conductive roller 128 depending on a signal of starting toner-supply, which is generated by a sensor 9 for detecting density of the toner through a control unit 19, so as for the electrical conductive roller 128 to become electrically charged to a polarity opposite to that of the toner.

By applying the negative voltage to the conductive roller 128, the toner on the toner supply roller 15 is electrostatically attracted to the conductive roller 128 and is clinged to its surface. After that, the toner on the conductive roller 128 is scraped off the roller 128 by a toner scraping blade 29 which is arranged to come in close contact under pressure with the surface of the roller 128, as shown in FIG. 12.

In this embodiment shown in FIGS. 12 and 13, there is no difference except the toner scraping mechanism 18*c* from the first embodiment shown in FIGS. 1 and 3. Therefore, there are omitted descriptions about other component elements, here, assuming that the descriptions must be referred to these of the first embodiment described previously. It is to be further noted that the rotating direction of the toner supply roller 15 is opposite to that of the first embodiment because of the arrangement of a toner charging blade 16 and a seal-blade 17, which is opposite to that of the first embodiment, as shown by an arrow (f). And also, the rotating direction of the electrically conductive roller 128 is as per shown by an arrow (g), and same reference numerals designate the same members.

Furthermore, the control procedure for the toner supply device in this embodiment is completely same as that of the first embodiment.

As disclosed the above-mentioned modification as one example of the first embodiment, there is anything else which can be disclosed as one of similar modifications of the other embodiments although such modifications are not shown in the drawings. That is, such modifications have the above-mentioned toner scraping mechanism 18*c* or similar one which can be displaced instead of the mechanical type-toner scraping mechanism in the toner supply devices of the embodiments described previously.

There can be disclosed a sixth embodiment as another modification in case the above-mentioned toner scraping mechanism 18*c* is disposed in the toner supply device described in the second embodiment, instead of the mechanical type-toner scraping mechanism 18. And also, a power supply unit for applying a negative voltage to the conductive roller is provided and controlled by the control unit. In this embodiment, the control unit controls the power supply unit to apply a negative voltage to the conductive roller when the toner on the toner supply roller has passed through the charging blade not less than twice and, after that, the control unit makes the power supply unit stop applying its voltage when the toner supply roller 15 turns completely once. Accordingly, pre-charged toner is always scraped off and supplied, so that imperfectly charging may be prevented. Of course, it does not matter that the toner supply roller is always driven, as described in the first embodiment.

There can be disclosed a seventh embodiment as another modification in case a toner scraping mechanism similar to the above-mentioned toner scraping mechanism 18*c* is disposed in the toner supply device described in the third embodiment, instead of the mechanical type-toner scraping mechanisms (two-portions type) 18*a* and 18*b*.

Here is brief descriptions about the seventh embodiment. Namely, there is disposed a roller of a material with electrical conductivity under a toner supply roller in such a way that there exists a predetermined gap between the electrically conductive roller and the toner supply roller. The electrically conductive roller is electrically divided into two portions with a insulating material disposed therebetween. This is a feature of this embodiment. Furthermore, the toner supply device has a pair of sensors for detecting density of the toner on a developing sleeve corresponding to each portion of the electrically conductive roller and a power supply unit to apply a negative voltage to the electrically conductive roller depending on a signal of starting toner-supply, which is generated by each sensor, under control of a control unit so as for the electrical conductive roller to become electrically charged to a polarity opposite to that of the toner. The control procedure described in the second embodiment is applied to this embodiment. That is, the toner scraping mechanism is controlled same as that of the sixth embodiment described above. In addition, since two sensors are provided in this embodiment, toner-supply to the developing sleeve can be carried out independently as same as that of the second embodiment. Of course, it does not matter that the control procedure of the toner scraping mechanism may be carried out in accordance with that of the first embodiment.

There can be further disclosed a eighth embodiment as another modification in case the above-mentioned toner scraping mechanism 18*c* is disposed in the toner supply device described in the fourth embodiment, instead of the mechanical type-toner scraping mechanism 18 with the brush-shape member. In this embodiment, it is a feature to provide an electric charge eliminating means together with an electrically conductive roller. So, only features of this embodiment are described hereinbelow.

There is disposed a roller of a material with electrical conductivity under a toner supply roller in such a way that there exists a predetermined gap between the electrically conductive roller and a toner supply roller. Further, charge eliminating means is provided which comprises a brush-shape member of a material with electrical conductivity and a base plate for supporting the brush-shape member, the base plate being electrically grounded and supported inside a developing tank. The above-mentioned brush-shape member is so arranged that it comes in close contact under pressure with the toner supply roller at the position located along its rotating direction as well as being downstream than the contact position of a toner scraping blade with the toner supply roller. As compared with the fourth embodiment, the brush-shape member on the base plate is stationarily disposed in the developing tank and is always kept in contact with the toner supply roller between the charging blade and a seal-blade. Therefore, a charge in the toner supply roller of which the peripheral portion becomes charged triboelectrically by contact of the charging blade and the toner scraping blade can be always leaked through the brush-shape member and is eliminated from that portion without fail. Accordingly, it is possible to prevent electrification of the toner from becoming lower and to achieve that efficiency of scraping toner by the toner scraping mechanism is ensured against getting worse.

These embodiments, i.e., the fifth to eighth embodiments, have a same function as corresponding embodiments, respectively and have the following advantage additionally. Namely, the structure of the toner scraping mechanism can be simplified because of no need of elements composing the mechanical mechanism for scraping the toner such as the solenoid, levers, linkages and so on.

Although the present invention has been fully described by way of example with reference to the accompanying drawings, it is to be noted, here, that various changes and modifications will be apparent to those skilled in the art. For example, although the method of detecting the toner density used in the first to eighth embodiments is the method of "ATDC", it is applicable to these embodiments that the method of "AIDC" disclosed in the U.S. Pat. No. 3,801,196, as well. Therefore, unless otherwise such changes and modifications depart from the scope of the present invention, they should be construed as included therein.

What is claimed is:

1. A toner supply device adapted to a developing device for developing a latent image on an electrostatic latent image support member by supplying toner to the latent image, which comprises:

a hopper for containing said toner;

a toner supply roller rotatably disposed below said hopper so as to fill an opening formed in a lower section of said hopper, said toner supply roller being simultaneously driven at the time when said developing device is driven;

a charging blade which is disposed so as to be in close contact under pressure with a peripheral surface of said toner supply roller to electrically charge said toner which is transported on said toner supply roller, so that a predetermined thickness of a toner layer is formed on the peripheral surface of said toner supply roller;

toner scraping means arranged at a position located downstream of said charging blade with respect to a rotational direction of said toner supply roller, by which said toner layer on said toner supply roller may be scraped off to be supplied to said developing device;

detecting means for detecting toner density; and control means for controlling said toner scraping means depending on signals from said detecting means so as to make said toner scraping means remove to one of a first position at which said toner scraping means comes in close contact under pressure with said toner supply roller and a second position at which said toner scraping means stands apart from said toner supply roller.

2. A device as claimed in claim 1, wherein said toner scraping means comprises:

a blade member being able to be brought into close contact with said toner supply roller along its longitudinal direction, said blade member being arranged at the position which is located in the obliquely downward direction from said toner supply roller;

a support member for supporting said blade member so that said blade member may swing between said first position and said second position; and means for making said blade member move to said first position and holding said blade member thereat.

3. A device as claimed in claim 1, wherein said toner scraping means comprises:

an electrically conductive roller rotatably driven simultaneously with said toner supply roller, said electrically conductive roller being arranged at the position which is located under said toner supply roller; and an electric power unit for applying voltage which is of a polarity opposite to that of said toner to said electrically conductive roller.

4. A toner supply device adapted to a developing device for developing a latent image on an electrostatic latent image support member by supplying toner to the latent image, which comprises:

a hopper for containing said toner;

a toner supply roller rotatably disposed below said hopper so as to fill an opening formed in a lower section of said hopper;

a charging blade which is disposed so as to be in close contact under pressure with a peripheral surface of said toner supply roller to electrically charge said toner which is transported on said toner supply roller, so that a predetermined thickness of a toner layer is formed on the peripheral surface of said toner supply roller;

toner scraping means arranged at a position located downstream of said charging blade with respect to a rotational direction of said toner supply roller, by which said toner layer on said toner supply roller may be scraped off to be supplied to said developing device;

detecting means for detecting toner density; and control means for controlling said toner scraping means depending on signals from said detecting means so as to make said toner scraping means move to one of a first position at which said toner scraping means comes in close contact under pressure with said toner supply roller and a second position at which said toner scraping means stands apart from said toner supply roller, the movement of said toner scraping means to said first position being carried out by said control means at the time when the toner on said toner supply roller has passed through said charging blade not less than twice.

5. A device as claimed in claim 4, wherein said toner scraping means comprises:

a blade member being able to be brought into close contact with said toner supply roller along its longitudinal direction, said blade member being arranged at the position which is located in the obliquely downward direction from said toner supply roller;

a support member for supporting said blade member so that said blade member may swing between said first position and said second position; and means for making said blade member move to said first position and holding said blade member thereat.

6. A device as claimed in claim 4, wherein said toner scraping means comprises:

an electrically conductive roller rotatably driven simultaneously with said toner supply roller, said electrically conductive roller being arranged at the position which is located under said toner supply roller; and an electric power unit for applying voltage which is of a polarity opposite to that of said toner to said electrically conductive roller.

7. A toner supply device adapted to a developing device for developing a latent image on an electrostatic latent image support member by supplying toner to the latent image, which comprises:

a plurality of detecting means for detecting toner density;

a hopper for containing said toner;

a toner supply roller rotatably disposed below said hopper so as to fill an opening formed in a lower section of said hopper;

a charging blade which is disposed so as to be in close contact under pressure with of a peripheral surface of said toner supply roller to electrically charge said toner which is transported on said toner supply roller, so that a predetermined thickness of a toner layer is formed on the peripheral surface of said toner supply roller;

toner scraping means arranged at a position located downstream of said charging blade with respect to a rotational direction of said toner supply roller, by which said toner layer on said toner supply roller may be scraped off to be supplied to said developing device, said toner scraping means being divided along the longitudinal direction of said toner supply roller so as to correspond to each of said detecting means; and control means for controlling said toner scraping means depending on signals from said each detecting means so as to make said toner scraping means respectively corresponding to said detecting means move to one of a first position at which each of said toner scraping means comes in close contact under pressure with said toner supply roller and a second position at which each of said toner scraping means stands apart from said toner supply roller.

8. A device as claimed in claim 7, wherein said toner scraping means comprises:

blade members divided into two portions along the longitudinal direction of said roller, which are located along the obliquely downward direction from said toner supply roller and may be, respectively, brought into close contact with said toner supply roller;

support members for independently supporting said respective blade members so that said respective blade members may swing between said first position and said second position; and means for making said respective blade members move to said first position independently and holding said blade members thereat.

9. A device as claimed in claim 7, wherein said toner scraping means comprises:

electrically conductive roller rotatably driven simultaneously with said toner supply roller and having two portions into which are electrically divided with insulation, said conductive roller being arranged at the position which is located under said toner supply roller; and an electric power unit for applying voltage which is of a polarity opposite to that of said toner to said each portion independently.

10. A toner supply device adapted to a developing device for developing a latent image on an electrostatic latent image support member by supplying toner to the latent image, which comprises:

a hopper for containing said toner;

a toner supply roller rotatably disposed below said hopper so as to fill an opening formed in a lower section of said hopper;

a charging blade which is disposed so as to be in close contact under pressure with a peripheral surface of said toner supply roller to electrically charge said toner which is transported on said toner supply roller, so that a predetermined thickness of a toner layer is formed on the peripheral surface of said toner supply roller;

toner scraping means arranged at a position located downstream of said charging blade with respect to a rotational direction of said toner supply roller, by which said toner layer on said toner supply roller may be scraped off to be supplied to said developing device; and means for taking a charge away from said toner supply roller, which comprises a member of a material with an electrical conductivity and is arranged at a position located downstream of said toner scraping means with respect to the rotational direction of said toner supply roller so as to be brought into close contact under pressure with the peripheral surface of said toner supply roller.

11. A device as claimed in claim 10, wherein said toner scraping means comprises:

a blade member being able to be brought into close contact with said toner supply roller along its longitudinal direction, said blade member being arranged at the position which is located in the obliquely downward direction from said toner supply roller;

a support member for supporting said blade member so that said blade member may swing between a first position at which said toner scraping means comes in close contact under pressure with said toner supply roller and a second position at which said toner scraping means stands apart from said toner supply roller; and means for making said blade member move to said first position and holding said blade member thereat.

12. A device as claimed in claim 10, wherein said toner scraping means comprises:

an electrically conductive roller rotatably driven simultaneously with said toner supply roller, said electrically conductive roller being arranged at the position which is located under said toner supply roller; and an electric power unite for applying voltage which is of a polarity opposite to that of said toner to said conductive roller.

* * * * *